US012264672B2

(12) United States Patent
Lo Biundo et al.

(10) Patent No.: US 12,264,672 B2
(45) Date of Patent: Apr. 1, 2025

(54) MOTOR VEHICLE OIL PUMP

(71) Applicant: O.M.P. OFFICINE MAZZOCCO PAGNONI S.R.L., Funo di Argelato (IT)

(72) Inventors: Giuseppe Lo Biundo, Partinico (IT); Carlo Pachetti, Cascina (IT)

(73) Assignee: O.M.P. OFFICINE MAZZOCCO PAGNONI S.R.L., Funo di Argelato (IT)

( * ) Notice: Subject to any disclaimer, the term of this patent is extended or adjusted under 35 U.S.C. 154(b) by 8 days.

(21) Appl. No.: 18/259,195

(22) PCT Filed: Dec. 27, 2021

(86) PCT No.: PCT/IB2021/062324
§ 371 (c)(1),
(2) Date: Jun. 23, 2023

(87) PCT Pub. No.: WO2022/144745
PCT Pub. Date: Jul. 7, 2022

(65) Prior Publication Data

US 2024/0052829 A1 Feb. 15, 2024

(30) Foreign Application Priority Data

Dec. 28, 2020 (IT) ..... 102020000032470

(51) Int. Cl.
*F04C 2/08* (2006.01)
*F04C 2/10* (2006.01)
*F04C 15/00* (2006.01)

(52) U.S. Cl.
CPC ..... *F04C 2/103* (2013.01); *F04C 2/084* (2013.01); *F04C 15/00* (2013.01); *F04C 15/008* (2013.01);
(Continued)

(58) Field of Classification Search
CPC ..... F04C 2/084; F04C 2/086; F04C 2/102; F04C 2/103; F04C 2/104; F04C 15/00;
(Continued)

(56) References Cited

U.S. PATENT DOCUMENTS 5,219,276 A * 6/1993 Metzner ..... F04C 15/008 417/356
2005/0186089 A1* 8/2005 Nakayoshi ..... F04C 15/008 417/410.4
2014/0119963 A1* 5/2014 Hadar ..... F04C 15/008 417/410.4

FOREIGN PATENT DOCUMENTS

EP 1566545 A2 8/2005
WO 2010/051640 A1 5/2010

OTHER PUBLICATIONS

International Search Report and Written Opinion for International Application No. PCT/IB2021/062324 filed Dec. 27, 2021 on behalf of O.M.P. Officine Mazzocco Pagnoni S.R.L. Mail Date: May 2, 2022. 13 pages.

* cited by examiner

*Primary Examiner* — Theresa Trieu
(74) *Attorney, Agent, or Firm* — Steinfl + Bruno LLP

(57) ABSTRACT

A motor vehicle oil pump, including: a pump body, an external rotor having a first plurality of lobes, an internal rotor having a second plurality of lobes configured to engage the first plurality of lobes of the external rotor, and a driving body rotatable with respect to the pump body about a first axis of rotation. The external rotor is constrained to the driving body. An idle shaft is rotatably connected to the pump body about a second axis of rotation parallel and eccentric to the first axis of rotation. The external rotor rotates about the first axis of rotation and is rotated by the driving body. The driving body is rotated by a motor. The
(Continued)

internal rotor is fitted onto the idle shaft for rotating about the second axis of rotation and is rotated by the external rotor.

12 Claims, 4 Drawing Sheets

(52) U.S. Cl.
CPC ..... *F04C 2240/51* (2013.01); *F04C 2240/52* (2013.01)

(58) Field of Classification Search
CPC ..... F04C 15/008; F04C 15/0061; F04C 2240/51; F04C 2240/52; F01C 11/008
See application file for complete search history.

MOTOR VEHICLE OIL PUMP

CROSS-REFERENCE TO RELATED APPLICATIONS

The present application is the U.S. National Stage of International Patent Application No. PCT/IB2021/062324 filed on Dec. 27, 2021 which, in turn, claims priority to Italian Patent Application No. 102020000032470 filed on Dec. 28, 2020.

FIELD

The present invention relates to a motor vehicle oil pump.

Preferably, the pump of the invention is used in the automotive sector, in particular as an oil pump in internal combustion engines and hybrid engines (in which an electric motor assists or replaces the internal combustion engine in certain situations) for motor vehicles.

BACKGROUND

The lubrication of an internal combustion engine (also known as a heat engine) is provided by a mechanical oil pump with a fixed or variable displacement, driven or otherwise activated by the heat engine. The oil pump generates a variable oil flow rate depending on the speed at which the heat engine is operating. Large-displacement pumps are therefore usually used to ensure sufficient oil flow when the engine is running at minimum speed. However, this results in oil flow rates in excess of actual lubrication requirements when the engine is running at high speeds.

Typically, medium power heat engines are combined with oil pumps that absorb a relatively high amount of power, e.g. around 1 kw.

In some types of application, an auxiliary oil pump is added to the traditional (or main) oil pump, usually substantially the same type as the main oil pump but driven by an electric motor. The function of the auxiliary oil pump is to ensure proper oil circulation in the heat engine when the engine is not running but still requires lubrication. By way of example, the auxiliary oil pump can lubricate the heat engine during temporary shutdowns implemented by the start and stop system, during temporary shutdowns in "coasting" conditions of the vehicle (i.e. when the vehicle is running at a constant speed and the heat engine is automatically switched off to reduce consumption and automatically switched on again as soon as the speed falls below a predefined value). The auxiliary oil pump can also be used on hybrid vehicles while running on electric power and with the heat engine switched off but requiring (at least temporary) lubrication.

SUMMARY

The auxiliary oil pump requires less power than the main pump and provides lower oil flow rates than the main pump. By way of example, a main oil pump has a maximum flow rate of 60 litres/minute (in a six-cylinder engine) and an auxiliary oil pump has a maximum flow rate of 5-6 litres/minute.

The Applicant has noted that such a relatively high value of power absorbed by the main oil pump leads to a decrease in the power actually delivered by the engine and usable for traction, resulting in a decrease in vehicle performance and, above all, an increase in fuel consumption.

The Applicant has further noted that in order to reduce the weight, fuel consumption, maintenance and production costs of a motor vehicle, it might be advantageous to have a single oil pump acting as both the main and auxiliary oil pump.

The Applicant has perceived that a single oil pump could be used to do this, which would ensure oil flow rates determined by the maximum flow rate required by the heat engine and which would be electrically driven instead of being driven by the heat engine.

However, the Applicant has found that such a pump, requiring a power absorption of up to 1 Kw, would not be easily powered without using electric charge accumulators of adequate capacity with consequent considerable increases in the cost of production, design and weight of the motor and therefore of the vehicle.

The technical problem underlying the present invention is to overcome the drawbacks discussed above.

The present invention therefore relates to a motor vehicle oil pump in accordance with the claims.

Such an oil pump comprises a pump body, an external rotor having a radially internal surface forming a first plurality of lobes, an internal rotor having a radially external surface forming a second plurality of lobes configured to engage the first plurality of lobes of the external rotor. The pump further comprises a driving body rotatable about a first axis of rotation with respect to the pump body and an idle shaft rotatably connected to the pump body about a second axis of rotation parallel and eccentric to the first axis of rotation. The external rotor is rotationally integral with the driving body rotating about said first axis of rotation and the driving body is rotated by a motor. The said internal rotor is fitted onto said idle shaft for rotating about said second axis of rotation, and the internal rotor is rotated by the external rotor.

In such an oil pump, the external rotor rotates together with the driving body, which is kinematically connected to a motor member. The external rotor rotates the internal rotor by engaging the first plurality of lobes with the second plurality of lobes. The internal rotor, rotating with respect to the idle shaft, rotates eccentrically with respect to the external rotor. In this way, a plurality of compression chambers are cyclically formed between the first plurality of lobes and the second plurality of lobes in which the oil is compressed and sent to a delivery line.

The Applicant has found that such an oil pump achieves a very high mechanical efficiency and viscous efficiency, thus reducing the power absorbed by the oil pump. This can save fuel for the engine on which the oil pump is installed and could also allow the oil pump to be operated electrically and also used as the engine's main oil pump.

In fact, the mechanical efficiency of the oil pump is defined by the formula $Rm=1-(Pm/Pass)$ as the complement to 1 of the ratio between the mechanical power dissipated (Pm) and the total power absorbed (Pass).

Since the external rotor and with it the internal rotor rotate supported by the driving body, the mechanical efficiency of the assembly provided by the external and internal rotor is essentially provided by the power dissipated by the driving body during its rotation with respect to the pump body. By choosing a coupling between the driving body and the pump body that minimises friction during rotation of the driving body, the mechanical efficiency can reach high values.

Furthermore, the external rotor, being rotationally integral with the driving body (which rotates about the first axis of rotation with respect to the pump body), does not need to fluctuate in the pump body and therefore does not need to be contained to measure and radially supported in a cylindrical seat obtained in the pump body. In other words, the external surface of the external rotor does not need to rub against a cylindrical seat to the size of the pump body in order to rotate about the first axis of rotation (i.e. it does not need to function as a bushing), further reducing the mechanical power dissipated.

Furthermore, the mechanical efficiency of the oil pump is defined by the formula Rvis=1−(Pvis/Pass) as the complement to 1 of the ratio of viscous power dissipated (Pvis) to total power absorbed (Pass).

Since the external rotor is supported and guided in rotation by the driving body, and, as mentioned, does not need to be contained fluctuating in a cylindrical seat made to measure in the pump body it is not necessary to provide a very small radial clearance between the external rotor and the cylindrical seat and to lubricate this radial clearance in order to radially support the rotation of the external rotor in the pump body. This drastically reduces the viscous power dissipated by the lubricant in such radial clearance.

Furthermore, since the external rotor does not need to fluctuate inside a cylindrical seat in the pump body, it is possible to avoid providing axial containment surfaces in the cylindrical seat or on the external rotor to act as thrust bearings for the axial fluctuations of the external rotor. This further reduces the mechanical power and the viscous power dissipated.

The Applicant has estimated that the mechanical efficiency of the oil pump can reach values of 0.98 or more and the viscous efficiency can reach values of 0.98 or more.

In the remainder of this description and in the subsequent claims, the expression "radial" refers to a direction contained in a plane perpendicular to the first axis of rotation. "Radially external" means further away from the first axis of rotation and "radially internal" means closer to the first axis of rotation.

The expression "axial" refers to a direction parallel to the first axis of rotation.

Preferred features of the above mentioned oil pump are recited in the dependent claims. The characteristics of each dependent claim can be used individually or in combination with those recited in the other dependent claims, except when in evident contrast.

Preferably, the oil pump comprises a guide shaft rotatable about the first axis of rotation; said guide shaft cooperating with the driving body during its rotation about said first axis of rotation.

Preferably, the oil pump comprises a bearing directly connected to the pump body to allow the driving body to rotate with respect to the pump body about the first axis of rotation. Such a bearing creates, in the preferred embodiments of the invention, the aforementioned coupling between the driving body and the pump body capable of minimising friction during rotation of the driving body.

Preferably, in a first embodiment said guide shaft is constrained to the driving body and the bearing is directly active on said guide shaft in such a way that the external rotor, the driving body and the guide shaft form a rotating assembly rotatably connected to the pump body via the bearing. The bearing is preferably the only part that physically connects, i.e. acts as the mechanical interface between, such rotating assembly and the pump body.

Preferably, the guide shaft is press-fitted on the bearing.

In the remainder of this description and in the subsequent claims, the expression "press-fit" or "press-fitting" means a union of two parts or components, obtained by mechanical interference, wherein the two parts or components are constrained to each other with respect to rotations and translations.

In a second embodiment, said bearing is directly active between the driving body and the pump body.

In this embodiment, the driving body preferably comprises a cylindrical portion crossed in the axial direction by the guide shaft; said cylindrical portion being press-fitted on the bearing.

The cylindrical portion extends away from the base wall of the driving body on the opposite side with respect to the side wall. In this embodiment, the guide shaft can pass through the cylindrical portion and be made to rotate with respect to the cylindrical portion (and thus with respect to the driving body) by a suitable bearing placed between the guide shaft and the cylindrical portion. In this case, the guide shaft is press-fitted in the pump body and acts as an additional guide for rotation about the first axis of rotation of the driving body with respect to the pump body.

However, in both embodiments, since the external rotor is rigidly mounted on the driving body, which is either rigidly connected to the guide shaft (which is press-fitted on the bearing) or is directly press-fitted on the bearing, it is possible to axially lock the driving body with respect to the pump body in a fixed and invariable axial position for each oil pump produced. This allows the external rotor and internal rotor to be reliably located at a predefined distance (e.g. 0.025 millimetres) from the inner wall of a pump body cover (and closing of the compression chambers), thereby increasing the efficiency of the oil pump as leakage of pressurised oil between the compression chambers becomes negligible.

In both embodiments, preferably the driving body comprises a base wall and a side wall that extends axially away from the base wall for defining an internal cavity of the driving body.

Preferably, the external rotor is inserted into said internal cavity and is constrained to said side wall.

Preferably, in order to constrain the driving body to the external rotor without radial or axial clearance, the external rotor is press-fitted into the internal cavity of the driving body.

Preferably, the oil pump comprises an electric motor having a rotor and a stator; said driving body being operatively connected to said rotor of the electric motor.

In this way, the operation of the external rotor (which is directly operated by the driving body), which in turn sets the internal rotor in rotation, is achieved with an electric motor, making the oil pump an electric oil pump.

The Applicant has found that the electric oil pump can be used effectively both as a main oil pump and as an auxiliary oil pump.

Preferably, the electric motor is driven in such a way that the speed of the oil pump (i.e. the speed of the external rotor) is less than or equal to 1800 rpm.

In particular, the maximum speed of 1800 rpm is set at the maximum oil flow rate required by the oil pump.

By way of example, the total efficiency of the oil pump can be calculated according to the formula RT=Pu/Pass={1/(1+Omega)}*Rv*Rm*Rvis*KP, where Pu is the power actually delivered by the pump, Pass is the power absorbed by the pump, Rv is the volumetric efficiency of the pump (ratio of the effective flow rate delivered by the pump to its displacement for the number of revolutions), Rm is the mechanical efficiency, Rvis is the viscous efficiency and KP is the ratio of the pressure delivered by the pump to the respective pressure inside it. Omega expresses the ratio between the power spent to circulate the oil flow inside the pump regardless of its pressure and the hydraulic power generated which depends on the internal pressure of the pump, and can be expressed by the formula Omega=K*n*Ri*Ri*rho/Pint, where K is a correction coefficient, n is the number of revolutions of the pump, Ri is the minimum radius of the internal rotor, rho is the effective density of the oil circulating in the pump and Pint is the internal pressure of the pump.

Typically, an electric oil pump running at about 3500-4000 rpm has an Omega value of about 0.55. Considering a traditional oil pump with an Rm of approx. 0.83-0.87, an Rvis of approx. 0.85-0.90, an Rv of approx. 0.95 and a KP of approx. 0.90, the total efficiency of the pump is 0.4 or less. For operating pressures of approx. 5 bar at a flow rate of approx. 40 litres/minute, such a conventional oil pump provides a hydraulic output of approx. 1.67*40*5=334 watts and draws a power consumption of approx. 835 watts.

Operating the oil pump at a maximum speed of 1800 rpm, the Omega value is approximately 0.1. Thus, considering the oil pump of the present invention with an Rm of about 0.98, an Rvis of about 0.98, an Rv of about 0.95 (as in conventional oil pumps) and a KP of about 0.90 (as in conventional oil pumps), the total efficiency of the pump is about 0.74. Thus, at about 1800 rpm at an operating pressure of about 5 bar with a flow rate of about 40 litres/minute, the oil pump of the present invention provides a hydraulic output of about 334 watts to the user and draws a power of about 450 watts.

In an embodiment of the invention, said rotor of the electric motor is preferably constrained to said guide shaft to rotate the guide shaft.

In this design, the stator of the electric motor is preferably attached to the pump body and the rotor of the electric motor is directly connected to the drive shaft, which is integral with the driving body. The operation of the electric motor operates the rotation of the guide shaft and, therefore, of the driving body and the external rotor of the oil pump.

In an alternative embodiment, the rotor of the electric motor is preferably directly constrained to the driving body. In this embodiment, the driving body is preferably directly press-fitted on the bearing.

In this design, the stator of the electric motor is preferably attached to the pump body and the rotor of the electric motor is directly connected to the driving body. The operation of the electric motor rotates the driving body and thus the external rotor of the oil pump.

Further characteristics and advantages of the present invention will become clearer from the following detailed description of the preferred embodiments thereof, with reference to the appended drawings and provided by way of indicative and non-limiting example.

DETAILED DESCRIPTION

Figure 1:
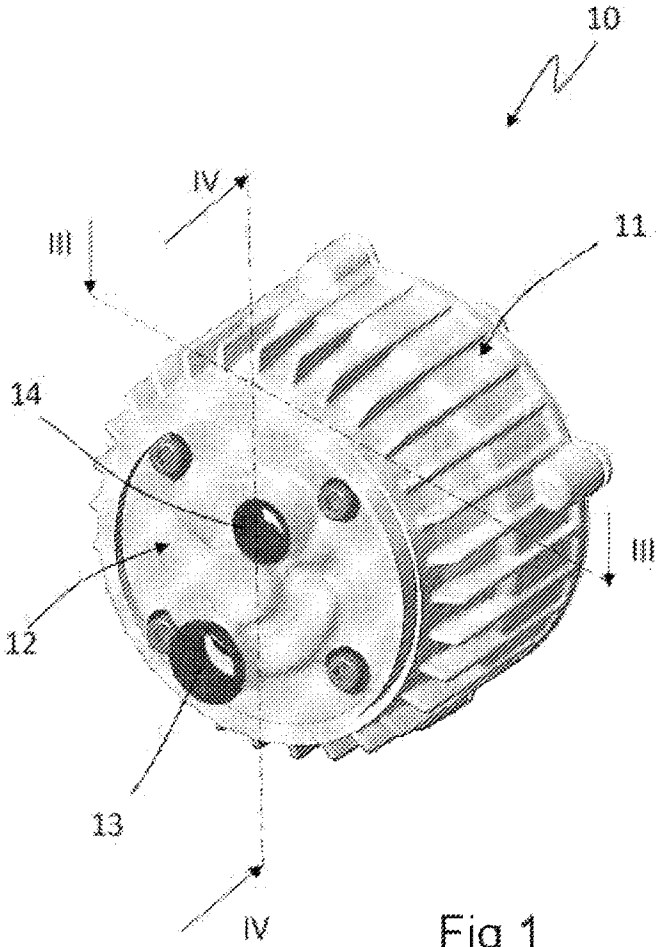
FIG. 1 represents a perspective view of a motor vehicle oil pump according to a first embodiment of the present invention.
Figure 2:
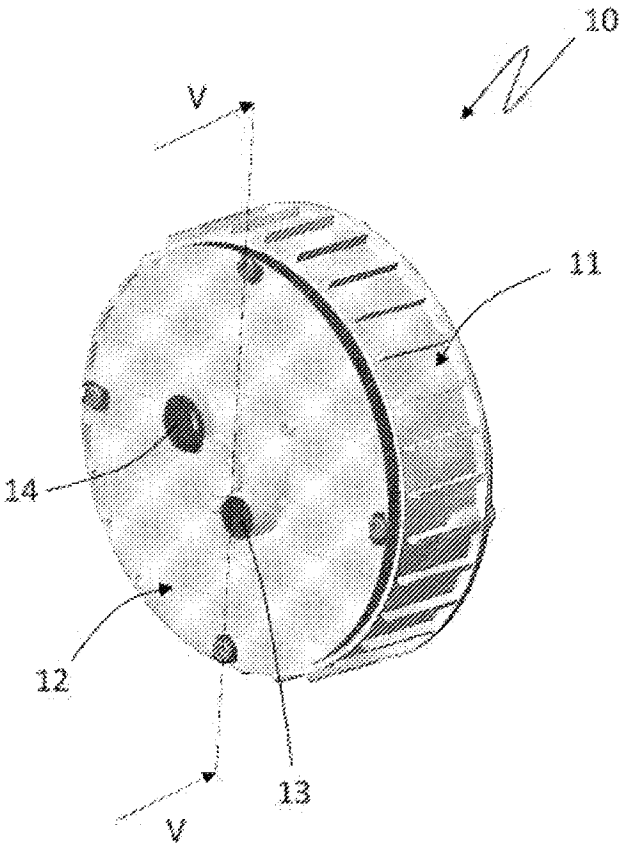
FIG. 2 represents a perspective view of a motor vehicle oil pump according to a second embodiment of the present invention.

With reference to FIGS. 1 to 5, some preferred embodiments of a motor vehicle oil pump 10 in accordance with the present invention are shown. Identical reference numbers refer to identical characteristics of each embodiment, the differences between them will become more apparent below.

The oil pump 10 comprises a pump body 11 closed by a cover 12. Two openings are made on the cover 12, which define a delivery opening 13 and a suction opening 14 for oil, respectively. The oil enters the pump body 11 through the suction opening 14 and the oil leaves the pump body 11 through the discharge opening 13. Preferably, the pump body 11 is made of a metallic material, preferably of aluminium or its alloys, or of steel or its alloys.

Figure 3:
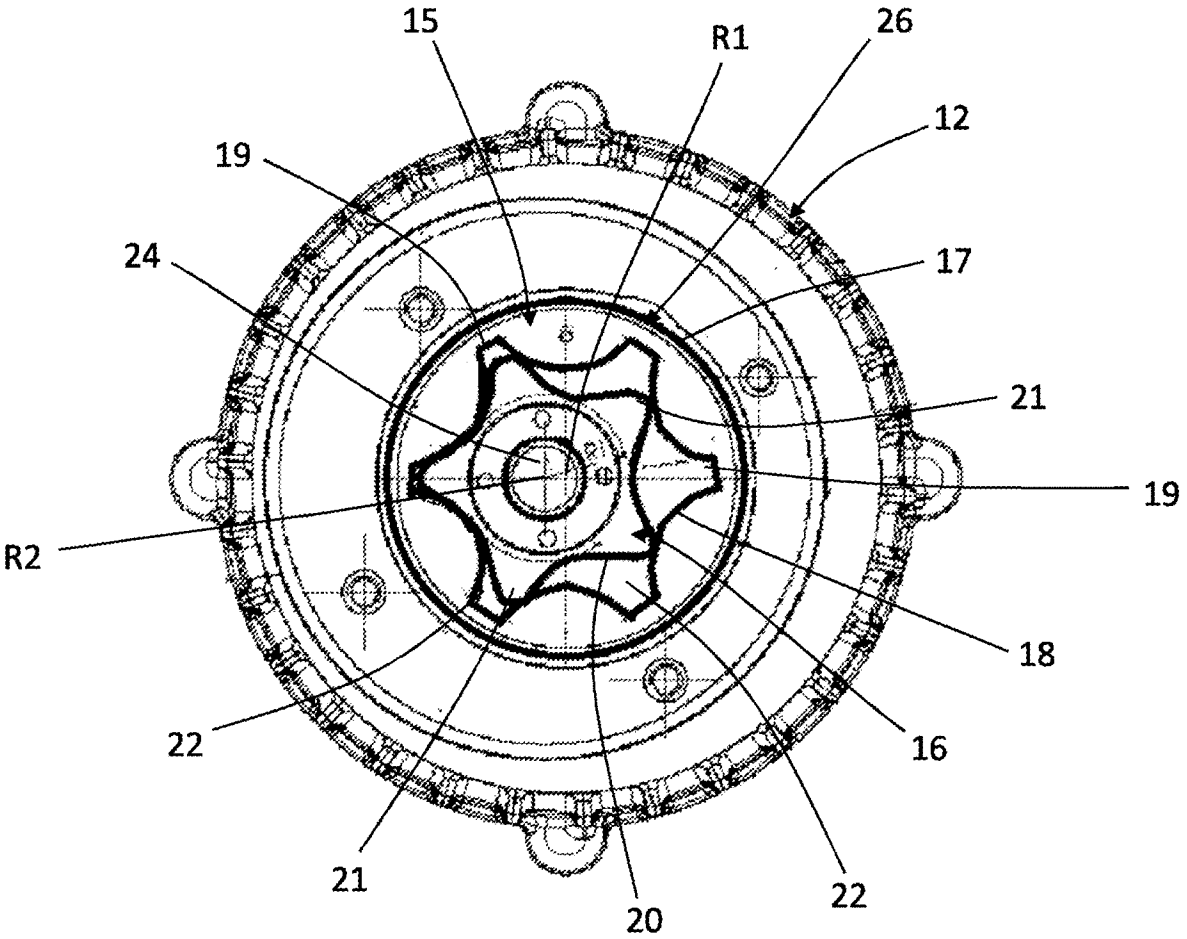
FIG. 3 schematically represents a section according to plane III-III of the oil pump of FIG. 1.

FIG. 3 essentially shows the oil pump 10 of FIG. 1 in a top view with the cover 12 removed. This figure may also represent, for the purposes of this description and net of differences which will appear below, the oil pump 10 of FIG. 2 in a view from above with the cover 12 removed.

As shown in FIG. 3, the oil pump 10 comprises an external rotor 15 and an internal rotor 16.

The external rotor 15 comprises a substantially cylindrical radially external surface 17 and a radially internal surface 18. The radially internal surface 18 is shaped to define a first plurality of lobes 19. In the illustrated embodiment, there are six lobes 19 of the first plurality of lobes, but there could be more or less than six.

The internal rotor 16 comprises a radially outer surface 20 shaped to define a second plurality of lobes 21. In the illustrated embodiment, there are five lobes 21 of the second plurality of lobes. In any case, irrespective of the number of lobes 19 of the first plurality of lobes, the lobes 21 of the second plurality of lobes 21 are equal in number to the lobes 19 of the first plurality of lobes less one.

The external rotor 15 is rotatably mounted inside the pump body 11 about a first axis of rotation R1 and the internal rotor 16 is rotatably mounted with respect to the external rotor 15 (and thus with respect to the pump body 11) about a second axis of rotation R2 parallel to and offset from the first axis of rotation R1, so that the internal rotor 16 rotates eccentrically with respect to the external rotor 15.

The internal rotor 16 is inserted inside the external rotor 15 and is rotated by the external rotor 15. The lobes 21 of the internal rotor 16 engage cyclically with the lobes 19 of the external rotor 15 during the rotation of the external rotor 15 and the internal rotor 16.

The mutual rotation between the internal rotor 16 and the external rotor 15 defines, by the engagement of the respective lobes 21, 19, a plurality of compression chambers 22 within which the oil is pressurised. The pressurised oil is discharged through the delivery opening 13. Each compression chamber 22 moves circumferentially (by the rotation of the internal rotor 16 and the external rotor 15) from a first position in which oil is introduced into the compression chamber 22 to a second position in which oil is expelled from the compression chamber 22. In the first position, the compression chamber is placed in correspondence and in fluid communication with the suction opening 14. In the second position, the compression chamber is placed in correspondence and in fluid communication with the delivery opening 13. During the movement of each compression chamber 22 from the first to the second position, the volume of the compression chamber 22 decreases by increasing the pressure of the oil contained therein. Once the oil has been expelled, the compression chamber 22, due to the relative rotation between the internal rotor 16 and the external rotor 15, returns from the second to the first position, increasing its volume. Once the first position has been reached, a new compression cycle begins.

Advantageously, the internal rotor 16 is driven in rotation by the external rotor 15, i.e. the rotation of the lobes 19 of the external rotor 15 puts the internal rotor 16 into rotation through the engagement of the lobes 19 with the lobes 21 of the internal rotor 16.

Figure 4:
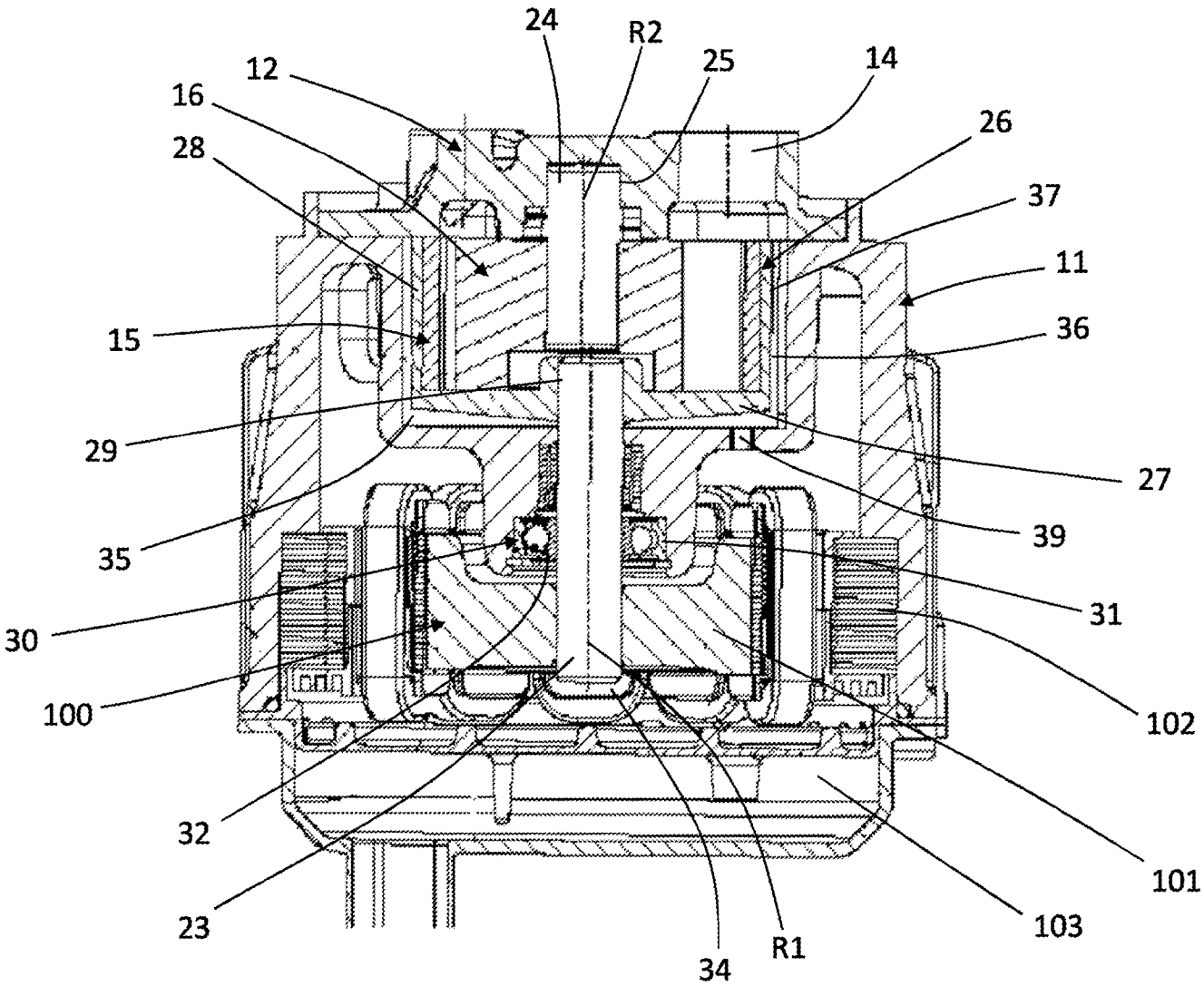
FIG. 4 schematically represents a section according to plane Iv-Iv of the oil pump of FIG. 1.
Figure 5:
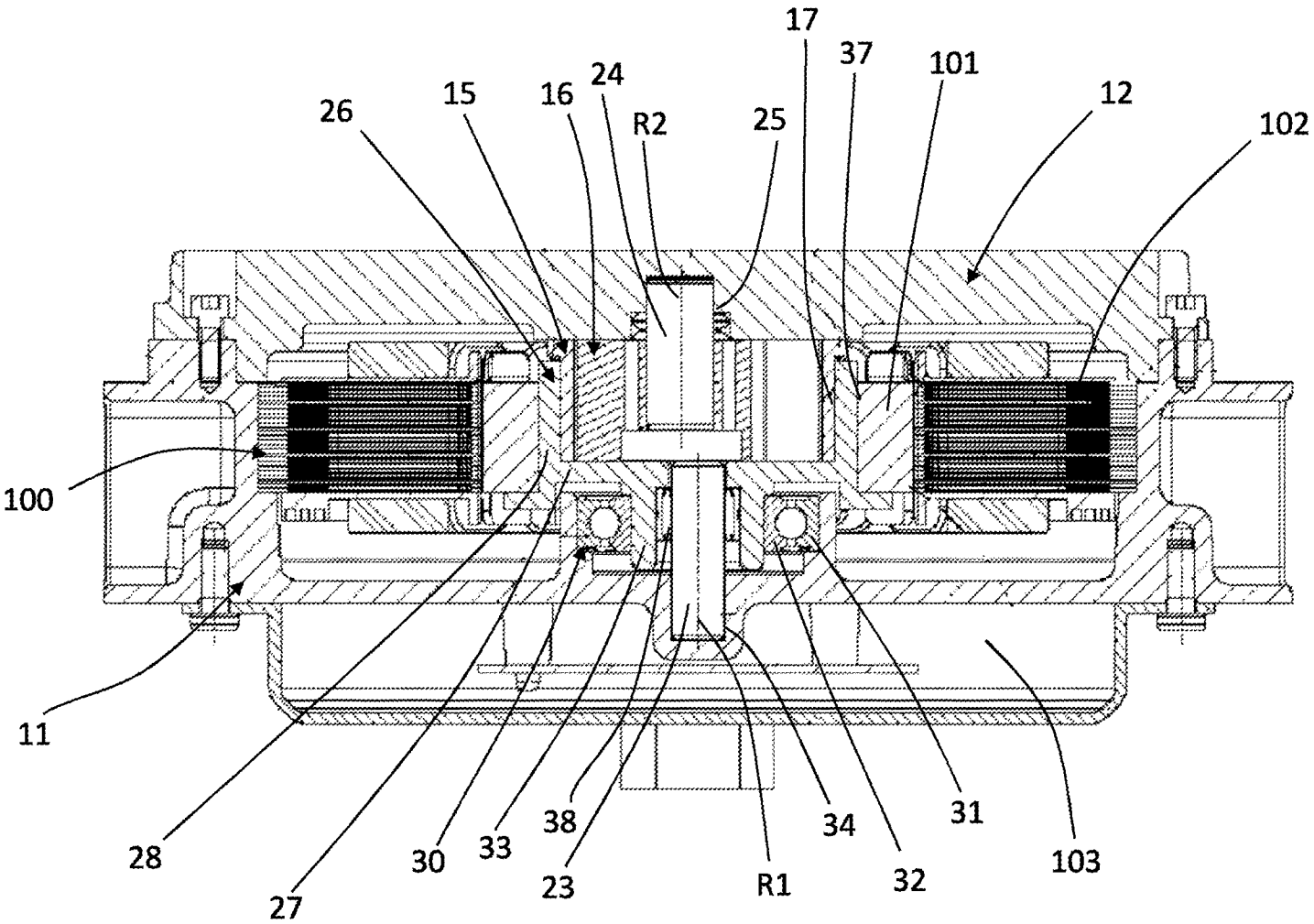
FIG. 5 schematically represents a section according to plane V-V of the oil pump of FIG. 2.

In this regard, the external rotor 15 is constrained radially and axially in rotation to a driving body 26 (FIGS. 4 and 5) which rotates about the first axis of rotation R1 and which is configured to be operated by a motor 100. The internal rotor 16 is guided in rotation about the second axis of rotation R2 by an idle shaft 24 coaxial with the second axis of rotation R2. As illustrated in FIGS. 4 and 5, the idle shaft 24 is integral with the internal rotor 16 (for example, it is press-fitted into the internal rotor 16 or is coupled thereto by means of a coupling flange), emerges axially from the internal rotor 16 and is rotatably inserted into a guide seat 25 obtained in the cover 12 of the oil pump 10.

The driving body 26 also has the function of housing the external rotor 15 and is guided in rotation about the first axis of rotation R1 or is assisted in rotation about the first axis of rotation R1 by a guide shaft 23.

As shown in FIGS. 4 and 5, the driving body 26 comprises a base wall 27 and a side wall 28 which develops axially away from the base wall 27. The base wall 27 and the side wall 28 are integral with each other. The side wall 28 is substantially annular and cylindrical in shape and is counter-shaped to the radially external surface 17 of the external rotor 15. The driving body 26 comprises an internal cavity having a closed end. The internal cavity is delimited by the side wall 28 and, at said closed end, by the base wall 27. The external rotor 15 is inserted into the internal cavity of the driving body 26 in contact with the side wall 28 of the driving body 26. In particular, the external rotor 15 is inserted into the internal cavity of the driving body 26 with the radially external surface 17 in contact with the side wall 28. The internal rotor 16 rotates inside the driving body 26. Preferably, the internal rotor 16 is in sliding contact with the base wall 27 of the driving body [25] 26. The compression chambers 22 are therefore bounded in the axial direction by the base wall 27 of the driving body 26. The compression chambers 22 are further delimited in the axial direction, on the opposite side with respect to the base wall 27 of the driving body 26, by the cover 12 of the pump body 11. The external rotor 15 is integral with the driving body 26, preferably press-fitted into the internal cavity of the driving body 26. The external rotor 15 has no radial or axial clearance with respect to the driving body 26.

The driving body 26 and with it the external rotor 15 rotate in the pump body 11 due to the effect of a single bearing 30. This bearing 30 comprises a radially external washer 31 directly connected to the pump body 11 and a radially internal washer 32.

In the embodiment illustrated in FIG. 4, the guide shaft 23 has the function of rotating the driving body 26. The guide shaft 23 is coupled to the base wall 27 of the driving body 26 and extends axially away from the base wall 27 on the opposite side with respect to the side wall 28. For this purpose, the base wall 27 comprises a housing seat 29 located in the centre of the base wall 27. The housing seat 29 can be made from a hole or a cavity which is open in the direction of the guide shaft 23 and closed in the direction of the side wall 28. The guide shaft 23 can be press-fitted into the housing seat 29 or made integral with it in some other way.

The rotating assembly comprising guide shaft 23, driving body 26, external rotor 15 and internal rotor 16 rotates inside the pump body 11 supported by the bearing 30. In other words, the only element which acts as an interface between (i.e. which connects) the rotating assembly which rotates in the pump body 11 (and which consists of guide shaft 23, driving body 26, external rotor 15 and internal rotor 16) and the pump body 11 is the bearing 30.

In the embodiment illustrated in FIG. 4, the radially internal washer 32 of the bearing 30 is directly connected to the guide shaft 23. The guide shaft 23 is press-fitted into the bearing 30 in such a way that there is no radial or axial clearance with respect to the pump body 11.

In the embodiment shown in FIG. 5, the driving body 26 is rotatable with respect to the guide shaft 23 and the latter has the function of helping the driving body to rotate about the first axis of rotation R1. In this respect, the guide shaft 23 is rotatably inserted into the base wall 27 of the driving body 26 and extends axially away from the base wall 27 on the opposite side with respect to the side wall 28. The driving body 26 comprises a cylindrical portion 33 extending axially away from the base wall 27 of the driving body 26 on the opposite side with respect to the side wall 28. The guide shaft 23 is rotatably inserted into the cylindrical portion 33 and the cylindrical portion 33 has an internal diameter greater than the diameter of the guide shaft 23. A bearing or bushing 38 may be provided between the guide shaft 23 and the cylindrical portion 33, which rotatably couples the guide shaft to the driving body 26. The pump body 11 includes a housing 34 for constraining and retaining the end of the guide shaft 23 (opposite the end rotatably inserted into the base wall 27 of the driving body 26) to the pump body 11.

In this embodiment, the cylindrical portion 33 is press-fitted into the bearing 30. In particular, the cylindrical portion 33 is in direct contact with the radially internal washer 32 of the bearing 30. The rotating assembly comprising driving body 26, external rotor 15 and internal rotor 16 rotates inside the pump body 11 supported by the bearing 30. In other words, the only element which acts as an interface between (i.e. which connects) the rotating assembly which rotates in the pump body 11 (and which consists of driving body 26, external rotor 15 and internal rotor 16) and the pump body 11 is the bearing 30.

In both embodiments of the invention, the motor 100 rotating the driving body 26 is an electric motor. The electric motor 100 comprises a rotor 101 and a stator 102. The stator 102 is integral with the pump body 11 and contained inside the pump body 11. The electric motor 100 is driven by a control unit 103 preferably contained in the pump body 11 and electrically connected to the electric motor 100. The control unit 103 is configured to limit the speed of the electric motor to 1800 rpm.

In the embodiment illustrated in FIG. 4, the rotor 101 of the electric motor 100 is directly connected to the guide shaft 23 and transmits to it a driving torque which sets the guide shaft 23 in rotation.

In this embodiment, the driving body 26 is inserted into a cavity 35 of the pump body 11 extending axially from the cover 12 to an area axially below the base wall 27 of the driving body 26, so that the cavity 35 can axially contain the driving body 26. The cavity 35 has a radial extension greater than the radial extension of the driving body 26. The cavity 35 is crossed by the guide shaft 23 and is in fluid communication with a portion of the pump body 11 housing the electric motor 100, preferably through a hole 39. A gap 36 having dimensions of not less than 5 millimetres, more preferably not less than 2 millimetres, is formed between the driving body 26 and the wall of the pump body 11 delimiting the cavity 35. In other words, the driving body 26 is inserted into the cavity 35 and is spaced both radially and axially from walls of the cavity 35 by distances of not less than 5 millimetres, more preferably not less than 2 millimetres. The gap 36 is filled with oil (the same oil on which the pump 10 operates) which enters through the suction opening 14 and which, through the hole 39, reaches the electric motor to cool it during operation.

In the embodiment illustrated in FIG. 5, the rotor 101 of the electric motor 100 is directly connected to the driving body 26 and transmits a driving torque thereto which sets it in rotation (and which consequently sets the guide shaft 23 in rotation). The rotor 101 is constrained to the side wall 28 of the driving body. As illustrated in FIG. 5, the rotor 101 is constrained to a radially external surface 37 of the side wall 28.

In order to satisfy specific and contingent requirements, a person skilled in the art will be able to make numerous modifications and variations to the motor vehicle oil pump described above with reference to the appended figures, all of which are included in the scope of protection of the present invention as defined by the following claims.

The invention claimed is:

1. A motor vehicle oil pump, comprising:

a pump body;

an external rotor having a radially internal surface forming a first plurality of lobes;

an internal rotor having a radially external surface forming a second plurality of lobes configured to engage the first plurality of lobes of the external rotor, wherein a number of lobes of the first plurality of lobes is equal to a number of lobes of the second plurality plus one;

a driving body rotatable with respect to the pump body about a first axis of rotation, wherein the external rotor is constrained to the driving body; and an idle shaft rotatably connected to the pump body about a second axis of rotation parallel and eccentric to the first axis of rotation, wherein:

the external rotor is rotatable about said first axis of rotation and is configured to be rotated by the driving body;

the driving body is configured to be rotated by a motor;

said internal rotor is fitted onto said idle shaft for rotating about said second axis of rotation;

said internal rotor is configured to be rotated by the external rotor; and said driving body comprises a base wall and a side wall extending axially away from the base wall for defining an internal cavity of the driving body, said external rotor being inserted into said internal cavity and being constrained to said side wall.

2. The motor vehicle oil pump according to claim 1, comprising a guide shaft rotatable about the first axis of rotation, said guide shaft cooperating with the driving body during rotation of the driving body about said first axis of rotation.

3. The motor vehicle oil pump according to claim 2, comprising a bearing directly connected to the pump body for enabling the rotation of the driving body with respect to the pump body about the first axis of rotation.

4. The motor vehicle oil pump according to claim 3, wherein said guide shaft is constrained to the driving body and wherein said bearing directly acts on said guide shaft so that the external rotor, the driving body and the guide shaft form a rotating assembly rotatably connected to the pump body through said bearing.

5. The motor vehicle oil pump according to claim 3, wherein said bearing directly acts between said driving body and said pump body.

6. The motor vehicle oil pump according to claim 5, wherein the driving body comprises a cylindrical portion crossed in an axial direction by the guide shaft, said cylindrical portion being press-fitted on the bearing.

7. The motor vehicle oil pump according to claim 2, comprising an electric motor having a rotor and a stator, said driving body being operatively connected to said rotor of the electric motor.

8. The motor vehicle oil pump according to claim 7, wherein said rotor of the electric motor is constrained to said guide shaft for rotating the guide shaft.

9. The motor vehicle oil pump according to claim 1, comprising a bearing directly connected to the pump body for enabling rotation of the driving body with respect to the pump body about the first axis of rotation.

10. The motor vehicle oil pump according to claim 9, wherein said bearing directly acts between said driving body and said pump body.

11. The motor vehicle oil pump according to claim 1, comprising an electric motor having a rotor and a stator, said driving body being operatively connected to said rotor of the electric motor.

12. The motor vehicle oil pump according to claim 11, wherein said rotor of the electric motor is directly constrained to the driving body.

* * * * *